US005315292A

United States Patent [19]

Prior

[11] Patent Number: 5,315,292

[45] Date of Patent: May 24, 1994

[54] CEILING MOUNTABLE SMOKE DETECTOR AND FIRE EXTINGUISHER COMBINATION

[76] Inventor: Mitchell K. Prior, 13661 Blue Sky Rd., Bella Vista, Calif. 96008

[21] Appl. No.: 2,703

[22] Filed: Jan. 11, 1993

[51] Int. Cl.[5] ..... G08B 17/10

[52] U.S. Cl. ..... 340/628; 169/61

[58] Field of Search ..... 340/628, 629, 630, 632; 169/26, 51, 54, 61

[56] References Cited

U.S. PATENT DOCUMENTS

| | | | |
|---|---|---|---|
| 4,691,783 | 9/1987 | Stern et al. | 169/61 |
| 5,016,715 | 5/1991 | Alasio | 169/61 |
| 5,123,490 | 6/1992 | Jenne | 169/61 |

*Primary Examiner*—Jeffery A. Hofsass

[57] ABSTRACT

A ceiling mountable smoke detector with audible alarm including a close-on-temperature-rise heat sensing switch which controls the activation of a solenoid controlled valve placed over the dispensing opening of a pressurized canister of fire extinguishing powder. The smoke detector and alarm function to sound an alarm upon sensing smoke. When smoke is being sensed simultaneously with sufficiently high heat around the smoke detector, the heat sensing switch closes to allow the activation and opening of the solenoid valve at which point fire retardant is dispersed in the immediate area. The smoke detector, audible alarm, the heat sensing switch, and the solenoid valve and fire retardant canister are built into a single easily installed assembly which may be mounted during new construction prior to the finished ceiling being applied, or may be installed as a "cut-in or remodeler unit" after the ceiling has been applied. When installed, the unit is semi-flush, having a significant portion of the unit above the finished ceiling while leaving only a relatively small and unobtrusive decorative trim plate of the unit exposed in the room through which the fire retardant is dispersed.

1 Claim, 7 Drawing Sheets

CEILING MOUNTABLE SMOKE DETECTOR AND FIRE EXTINGUISHER COMBINATION

BACKGROUND OF THE INVENTION

1. Field of the Invention

This invention relates to safety devices and fire fighting equipment in general, and particularly to a smoke detector with audible alarm and fire extinguishing capabilities in a single, easily mounted housing.

2. Description of the Prior Art

Smoke detectors with audible alarms have been required in most residences in the U.S. for quite a few years. Typical smoke detectors with alarms are complete assemblies or units in a single small housing. The housing normally includes the smoke detecting and audible alarm electronics, a power supply for conditioning and directing the proper electrical power from 120 volts AC or 9 volts DC to the electronics, and also an alarm horn or buzzer, and all contained within the small housing structure attachable to an electrical box or directly to the ceiling. Typical smoke detectors function to sense smoke either by sensing atomic particles using an ionization process, or by seeing smoke particles using a photoelectric process. With either sensing process, when smoke is detected, the smoke detector triggers an audible alarm intended to awaken or alert the occupants of the danger. If the residence is empty, such as when the owners are at work, the audible alarm is normally not sufficiently loud to alert the neighbors, and this being in-part due to the audible alarm normally stemming directly from the smoke detector unit within the interior of the residence, and consequently, a fire can become quite large before being noticed.

There is a trend in the U.S. to render residences more safe against all hazards, including fire and smoke hazards. This trend in some areas is leading to the increased mandating of automatic fire-extinguishing water sprinkle systems, even in single story buildings. Such sprinkle systems in the past were normally only required in multi-story apartments and condominiums, and in commercial/industrial buildings. Although water sprinkle systems are effective at slowing or extinguishing fires in the immediate area of the sprinkler head(s), they are costly to install, and particularly costly to install after the building has been completed, such as during a remodel when the finished ceiling is already in place. Additionally, if the sprinkler system is triggered, water from the system will mix with smoke causing a mixture which is very damaging to the building and furniture, and therefore water or liquids are not the ideal fire retardant from that view point.

Several combination smoke detector with fire extinguisher units have been developed in the past which use dry powered or gaseous fire retardants which are less damaging to the building and furniture than water because they are dry and can simply be vacuumed up. However, none of the prior art combination smoke detector with fire extinguisher units of which I am aware are structured the same as the present invention, and none are believed to be capable of providing equal benefits in similar applications as the invention of this disclosure.

SUMMARY OF THE INVENTION

The present invention is a combination smoke detector with audible alarm and automatic fire extinguisher for mounting in the ceiling of a room. The present invention is primarily or best suited for use in residences, being physically small in size, relatively simple to install just about anywhere, and is believed to be aesthetically pleasing, or at least not displeasing. Under most applications, such as in a residential kitchen, bedroom or bathroom, one smoke detector and fire extinguisher unit would be mounted at ceiling height in the approximate center of the room. In large rooms or long narrow hallways, additional smoke detector and fire extinguisher units may be utilized in a spaced apart relationship. Conceivably my invention may also be used in an attic using its adjustable attachment arms if desired.

My smoke detector and fire extinguisher unit mounts as a "semi-flush" unit, wherein a significant portion of the unit is above the finished ceiling leaving only a relatively small and unobtrusive portion of the unit exposed in the room, and thus, a relatively large pressurized canister of dry powder-type fire retardant may be used with a small appearing or low profile unit.

My smoke detector and fire extinguisher unit is additionally equipped to use either household voltage which is normally 120 volts AC in the U.S.A., or it may utilize electrical power from a battery or batteries when household voltage is not readily available. My smoke detector and fire extinguisher unit is also equipped with two distinct attachment systems in order to provide for easy installation under all normal conditions of new construction or remodeling, regardless as to whether the finished ceiling is in place at the time of installation, or as to whether there exists an attic or crawl space above the finished ceiling.

Reliability, and ease and versatility of installation are all major objects of the present invention. Providing a potentially aesthetically pleasing unit is also a major object and concern of the present invention, in that my smoke detector and fire extinguisher unit is intended to be suitable for use in residential as well as offices where appearance may be very important. Ease of disassembly for servicing the fire retardant canister since they must normally be serviced periodically, and for servicing other components is also a concern addressed with the present invention. A smoke detector and fire extinguisher which could meet the previously mentioned objects and be manufactured at a relatively low cost is another object of the present invention. It is believed that the present invention is a suitable and cost effective substitute for fire sprinkle systems in many applications, particularly in residences whether under new construction or during remodeling.

Additional structuring of the present invention which allows my smoke detector and fire extinguisher to meet the mentioned objects as well as other objects will be better understood with continued reading and an examination of the drawings of a preferred embodiment given for example. For the sake of briefness, only one preferred embodiment or example of the invention in physical form will be given with the belief that those skilled in the art will readily recognize modifications in that described and shown may be made without departing from the true invention being set-forth.

DESCRIPTION OF A PREFERRED EMBODIMENT

Figure 1:
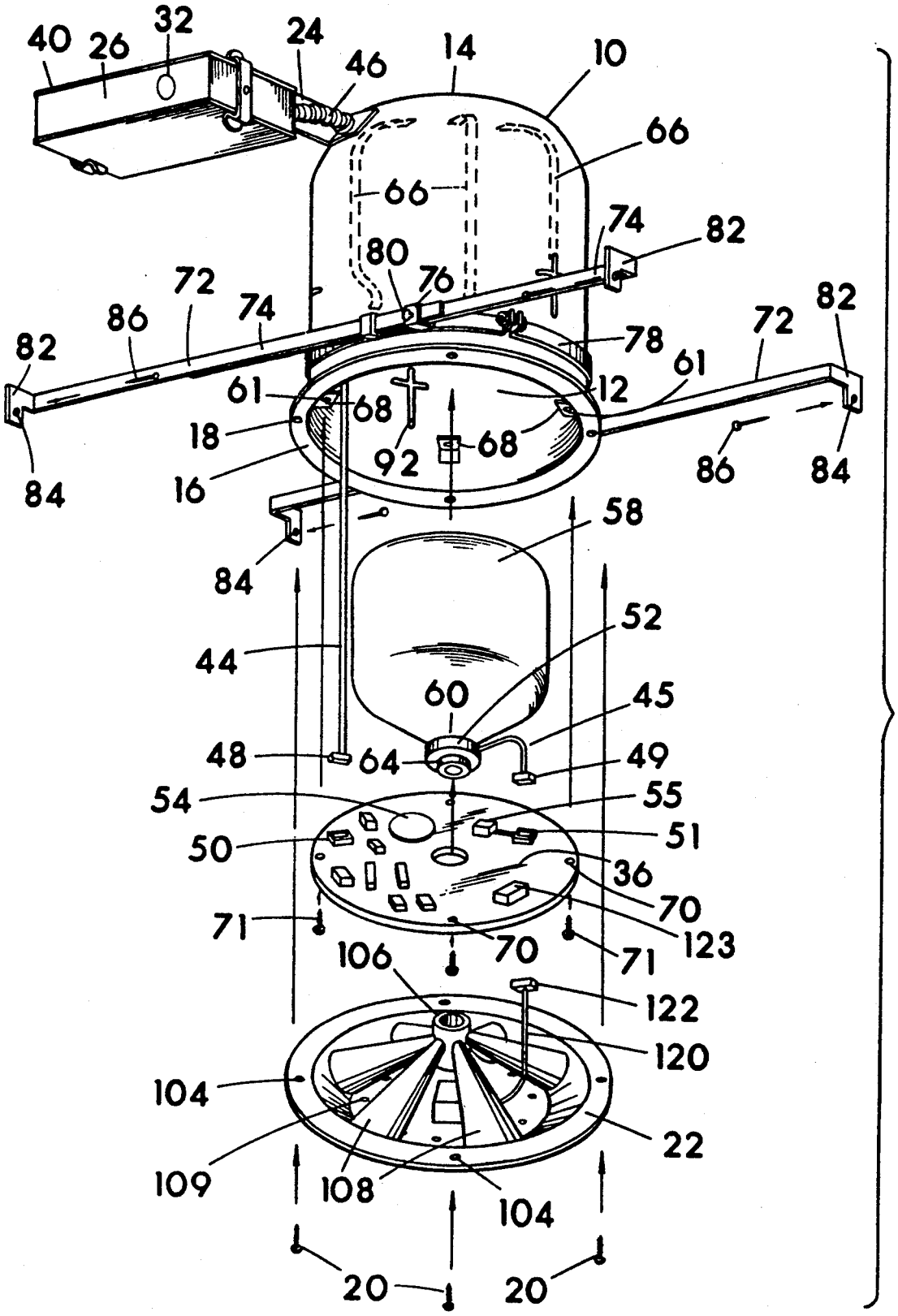
FIG. 1 is an exploded view of a preferred embodiment of the present invention shown with length adjustable attachment arms on the housing portion of the embodiment.

Referring now to the drawing figures in general, and particularly to FIG. 1 which is an exploded view of a preferred embodiment of the present invention, which includes a housing 10 which in this example of the invention is a cylindrical member having one opened end 12 and an oppositely disposed closed end 14. Housing 10 may be made of sheet metal. The opened end 12 of housing 10 being considered the bottom end, and the closed end of housing 10 being considered the top end because of the orientation thereof when installed in a ceiling 94. The opened end 12 of housing 10 includes an outwardly extending annular flanged rim, designated flange 16, which serves as a surface to which to abut to the finished ceiling 94 of the room. Flange 16 also includes screw apertures 18 for receiving mounting screws 20 used to removably attach the trim plate 22. The trim plate 22 which includes a powder manifold and distributor will be described in detail later.

Figure 2:
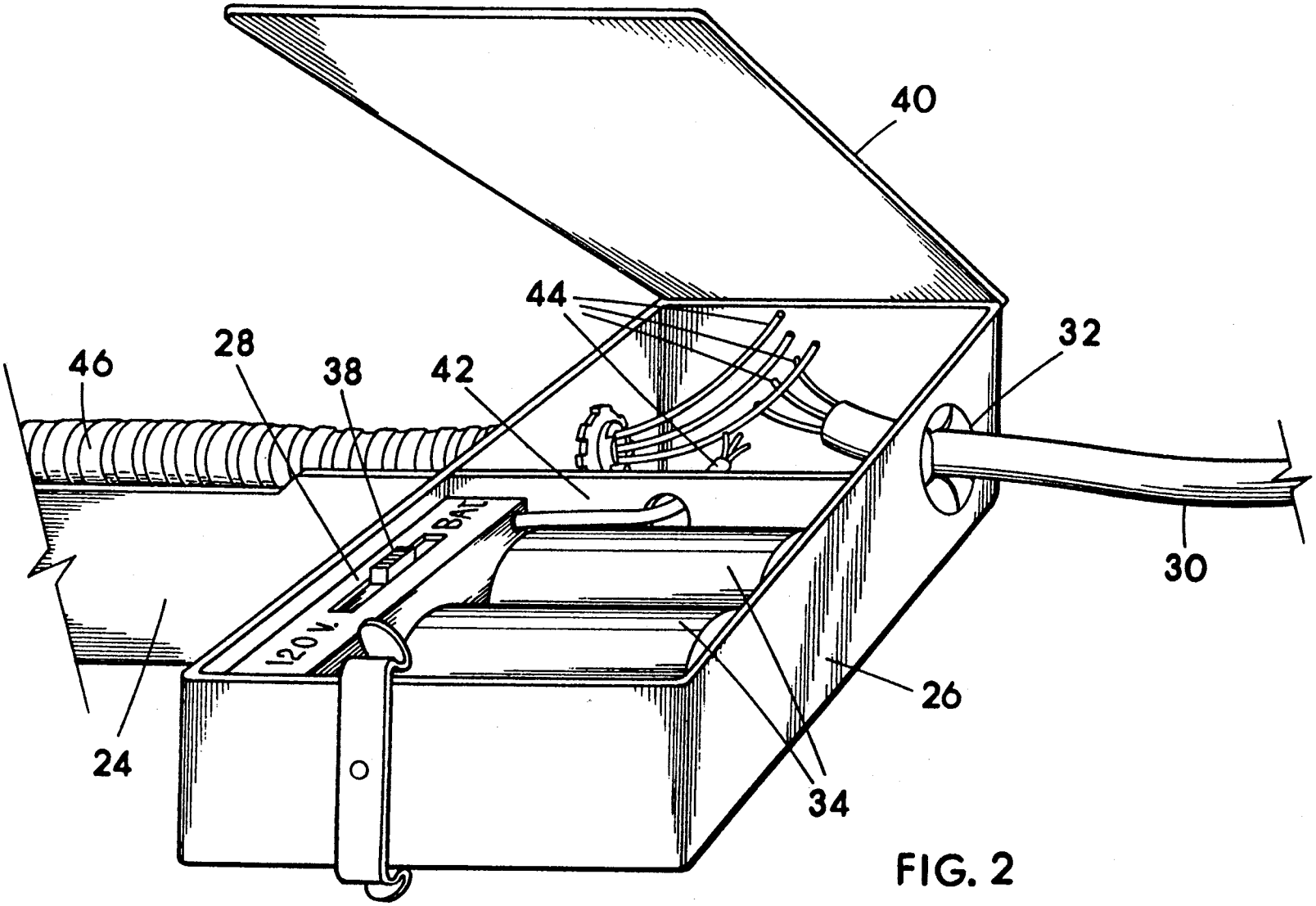
FIG. 2 is an enlarged view of a power supply and junction box (shown open) of the embodiment of FIG. 1.
Figure 4:
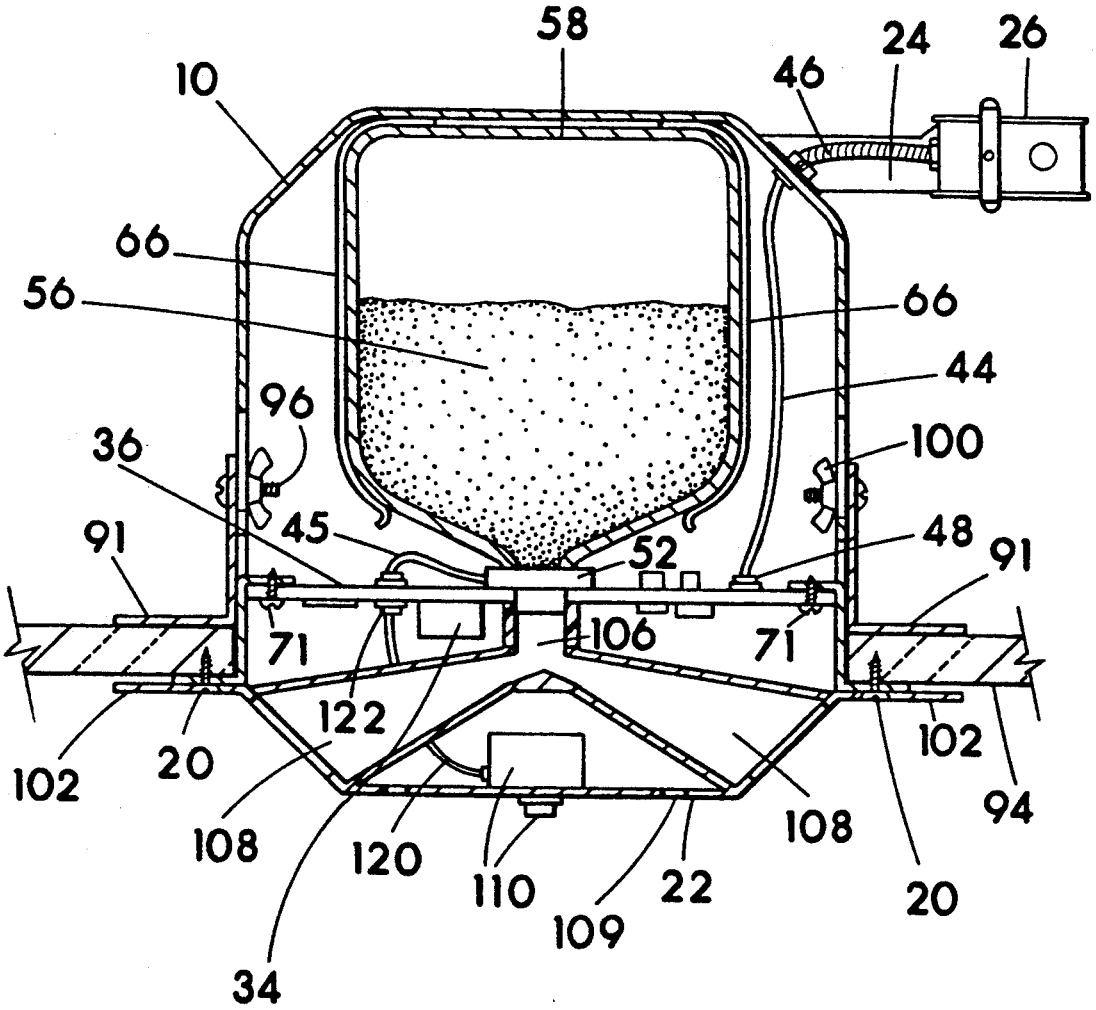
FIG. 4 is a partial cross-sectional view of the present invention shown mounted in a ceiling with attachment clips used during remodel where the finished ceiling is in place at the time of installation of the smoke detector/fire extinguisher unit.

A support or mounting bracket 24 is attached at one end thereof to the exterior closed end of housing 10, and the opposite end of the mounting bracket 24 is attached to and supports electrical junction box 26. Junction box 26 contains a power supply 28 which serves to condition, rectify, regulate and or transform electrical power for supplying it to the power consuming components of the invention. The junction box 26 is for making electrical wire connections with the power supply 28 such as household power normally 120 volts AC (alternating current). The conductors or cable 30 carrying the household power would be inserted through a knockout opening 32 as in FIG. 2. When 120 volt AC is not readily available, such as may occur during a remodel, particularly in a multi-story building, a battery or batteries 34 may be used as the sole electrical power source for the invention. The smoke detector circuit board 36 and related electrical components for sounding the audible alarm and releasing the fire retardant power are all operated on low voltage such as 3 or 6 or 9 volts DC (direct current) for example. When high voltage is available such as from household 120 volts AC, the power supply transforms and rectifies the voltage to the low voltage DC operational power previously discussed. The power supply 28 includes a switch 38 which includes a position for setting the power supply 28 to operate from 120 volts AC or from the DC battery 34 power. In FIG. 2, the lid or cover 40 of the junction box 26 has been opened, and batteries 34 are shown in one end, and the opposite end of the junction box 26 is the high voltage section generally separated by a dividing wall 42. The batteries 34 may be attached to smoke detector circuit board 36 as shown in FIG. 4 instead of being placed in junction box 26, and the batteries 34 may be more conveniently changed when depleted from the mounting place on circuit board 36. The power supply 28 could also be mounted on smoke detector circuit board 36 rather than in junction box 26. A circuit and the necessary wires to allow the linking of the smoke detector audible alarm portion with other smoke detector and fire extinguisher units in a single building so that when the audible alarm sounds in one, it sounds in the linked units is anticipated. This linking is common in typical prior art smoke detectors.

In FIG. 1, a conduit 46 is shown extending from junction box 26 into the top or closed end 14 of the housing 10. Flexible electrical conductors 44 from the low voltage or load side of the power supply 28 extend from the power supply 28 through the conduit 46, and through the open interior of the housing 10 to reach smoke detector circuit board 36. More or fewer conductors 44 in conduit 46 may be used to supply the necessary line and load side conductors depending on where the batteries 34 and power supply 28 are located as previously discussed. A plug 48 on the end of conductor 44 releasibly inserts into an electrical receptacle 50 on smoke detector circuit board 36, and thus the electrical components of the smoke detector circuit board 36 and solenoid valve 52 are fed electrical power. Smoke detector circuit board 36 includes the electronics necessary to detect smoke and to trigger an audible alarm which causes the speaker or horn 54 on the circuit board 36 to audibly broadcast an alarm or tone. Smoke detector circuit board 36 may be structured to sense smoke either by sensing atomic particles using the ionization process, or by seeing smoke particles using the photoelectric process, or by any other feasible process.

Additionally, and possibly most feasibly attached on smoke detector circuit board 36, but possibly mounted elsewhere such as on housing 10, is a normally open close-on-temperature-rise heat sensing switch 55, which is an electrical switch having a set of normally open electrical contacts, which is connected to an electrical receptacle 51 to which a plug 49 on flexible conductors 45 removably plugs into in order to feed electrical power to a normally closed solenoid valve 52. Those skilled in the art will recognize that the heat sensing switch 55 could be a normally closed switch if additional electrical components such as an electromagnetic coil with normally closed (N.C.) contacts were used and continuous electrical power was fed through the N.C. contacts of the heat sensing switch 55 to hold the N.C. contacts of the electromagnetic coil open, thus maintaining an open circuit to solenoid valve 52. However it seems simpler to just use heat sensing switch 55 with normally opened contacts closable by a bi-metal strip (part of the switch) which warps with an abnormally high heat of maybe 120 degrees fahrenheit or above to complete the circuit to solenoid valve 52.

The solenoid valve 52 will be open only when smoke is being sensed simultaneously with sufficient heat around the close-on-temperature-rise heat sensor switch 55 wherein the heat sensing switch 55 closes to complete the circuit and allow the activation of the solenoid valve 52 at which point a quantity of fire retardant powder 56 is dispersed in the immediate area from a pressurized canister 58. If the heat sensing switch 38 closes without the smoke detector having already sensed smoke, which would be a very unusual situation, then there will be no electrical power passing through the heat sensing switch 55 to operate the solenoid valve 52. Electrical power is sent to the normally open close-on-temperature-rise switch 55 only after smoke has been sensed, for example the electrical power may be taken off of the switched or normally electrically dead side of horn 54 circuit which only has electrical power after smoke has been sensed. If smoke is being sensed and the audible alarm is sounding, and there is sufficient heat to close the electrical contacts of the heat sensor switch 55, then solenoid valve 52 will be opened by the electromagnetic coil, and fire retardant powder 56 will be released to hopefully put out the fire or at least slow it down. Solenoid valve 52, which is a normally closed valve, is positioned over the dispensing opening 60 of the pressurized canister 58 of fire retardant powder 56. Upon activation of solenoid valve 52, fire retardant powder 56 is released or dispersed from my invention into the room. With this arrangement, the audible alarm will be able to sound, and most likely will be occasionally activated from cooking or cigarette smoke without solenoid valve 52 needlessly opening and releasing fire retardant powder 56 into the room, and this being due to the lack of sufficient heat to cause heat sensor switch 55 to close and complete the electrical circuit to the solenoid valve 52.

When installed, the pressurized canister 58 is positioned within housing 10 with the dispensing neck with opening 60 aiming downward so as to be able to disperse fire retardant 56 out through the opened end 12 of housing 10. A central aperture 62 in smoke detector circuit board 36 provides an opening through which a short pipe nipple 64 on the output side of solenoid valve 52 extends a short distance as may be seen best in FIG. 4. This is an arrangement which allows for the fire retardant powder 56 to be dispersed downward essentially through the bottom or opened end 12 of the housing 10 without the smoke detector circuit board 36 blocking the flow of the powder 56. The smoke detector circuit board 36 may also serve to partially support and stabilize the canister 58 in housing 10. The canister 58 is positioned higher in the housing 10 than is the smoke detector circuit board 36, as it is believed earlier detection of smoke and heat may be obtained by maintaining the smoke and heat sensing components in close proximity to the ambient room air being monitored. Canister 58 is removably retained within housing 10 by three equal distantly spaced clips 66 attached within the interior of housing 10. As may be ascertained from FIGS. 1 and 4, clips 66 are elongated spring or resilient members attached at the top ends thereof to the interior surface of the closed end 14 of housing 10. The lower ends, that is the ends of clips 66 closest to the opened end 12 of housing 10 are left unattached. Clips 66 are roughly shaped the same as the outside of the canister 58. Clips 66 are flexible and resilient, and positioned so that canister 58 may be pressed in between the clips 66 at which time the clips 66 move outward until canister 58 is fully inserted between the clips 66 within housing 10, and the clips 66 spring back to removably retain the canister 58 within the housing 10 by frictional engagement or adhesion, particularly around the narrowed neck portion of the canister 58.

With canister 58 removably retained within the housing 10, the smoke detector circuit board 36 may be brought close to the opened end 12 of the housing 10. The plug 48 on the end of the conductors 44 should now be inserted into its receptacle 50, and the plug 49 and the end of conductors 45 should be inserted in its receptacle 51. The smoke detector circuit board 36 may be brought to abut a plurality of inwardly extending tabs 68 which posses screw receiving apertures 61. Tabs 68 are positioned in spaced apart relationship from one another within the interior of housing 10 close to the opened end 12 thereof. Smoke detector circuit board 36 includes a plurality of screw apertures 70 which may be indexed to screw receiving apertures 61 so to allow mounting screws 71 to be used to removably attach the smoke detector circuit board 36 within housing 10 below canister 58.

Figure 3:
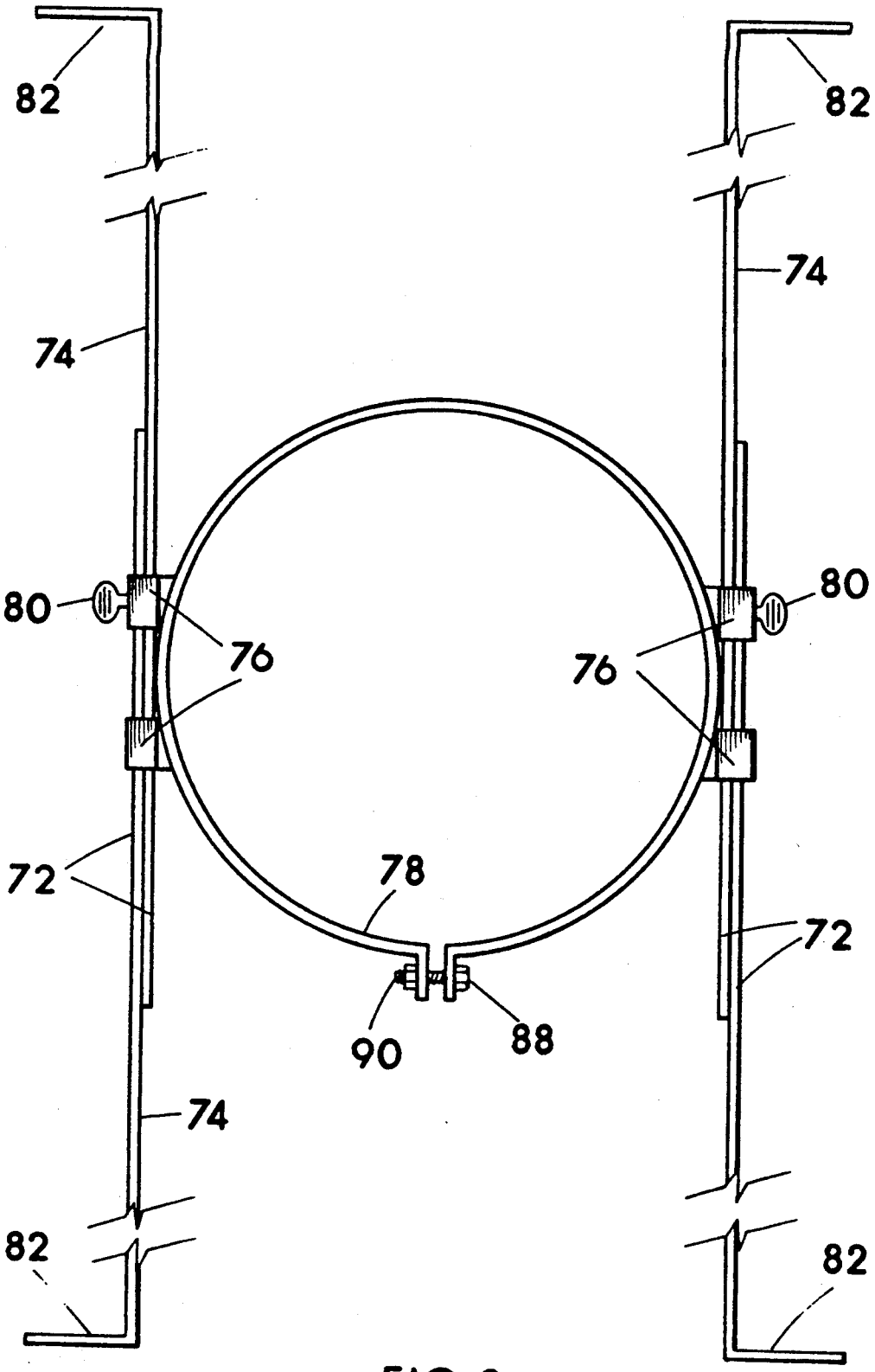
FIG. 3 is an illustration of a support ring with the adjustable attachment arms which may be utilized.

Housing 10 may be attached to and supported by members of the building by either of two attachment systems. The first attachment system, and the one which is likely to be used most, uses two sets of length adjustable attachment arms 72 shown in FIG. 1 and 3. Attachment arms 72 are essentially the same as are used for attaching recessed lighting housings to floor or ceiling joists. Attachment arms 72, one set on each oppositely disposed side of housing 10, each include two arm members 74 placed adjacent one another within two adjacent lugs 76, or a set of lugs 76. At least one of the lugs 76 of the set includes a thumb set-screw 80 used to releasibly secure the two arm members 74 stationary relative to one another and relative to a band 78 to which lugs 76 are attached. With set-screw 80 loose, the two adjacent arm members 74 may be slid relative to one another in order to adjust the distance between the two oppositely disposed distal ends 82 of the arm members 74. The sliding of the arms 74 may also be used to reposition the arm members 74 relative to the band 78, which as will be understood repositions the arms relative to housing 10 so as to compensate for varying widths between joists and to be able to secure housing 10 closer to one joist or the other as required or desired. The distal end 82 of each of the arm members 74 is bent 90 degree and includes an aperture 84 through which a nail 86 may be inserted and used to secure the distal end 82 to a joist. Lugs 76 are attached to band 78. Band 78 is sized to fit over the outside of housing 10. Band 78 includes a gaped or spaced portion where two ends of the band 78 are brought adjacent one another. The ends of the band 78 are bent outward 90 degrees, and each include a bolt aperture through which a bolt 88 is passed and secured by a nut 90. The tightening of nut 90 and bolt 88 reduces the diameter of band 78 and thereby secures band 78 stationary on housing 10. With nut 90 and bolt 88 loose, band 78 may be slipped over the closed end 14 of housing 10 to either remove, or install the band 78 on housing 10. Band 78 may be positioned as desired relative to the opened end 12 of housing 10 as required based on factors such as finished ceiling 94 thickness and location of attachment of attachment arms 72 to the building members, whether high or low relative to the bottom edge of the joists. Normally, particularly during new construction, housing 10 with attached band 78 and attachment arms 72 will be secured, spanning across two building members which will normally be joists, followed by connecting batteries 34 or 120 volt AC power, followed by installing canister 58, then smoke detector circuit board 36, and after the finished ceiling 94 is completed, the installation is completed with the attachment of trim plate 22. This order may be varied depending on a number of variables, particularly in remodeling.

Figure 5:
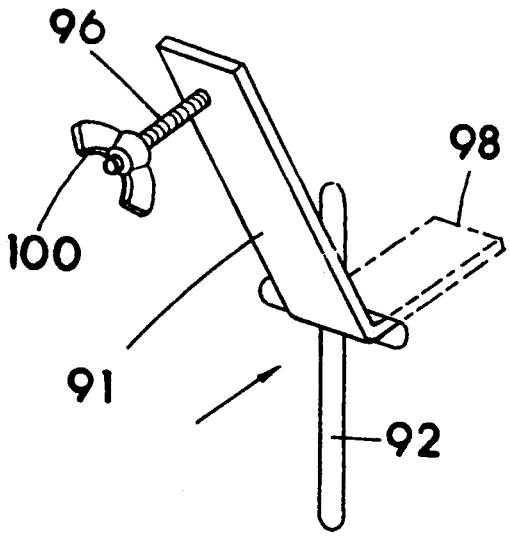
FIG. 5 is a view showing the beginning phase of installing an attachment clip in the housing of the smoke detector/fire extinguisher unit.
Figure 6:
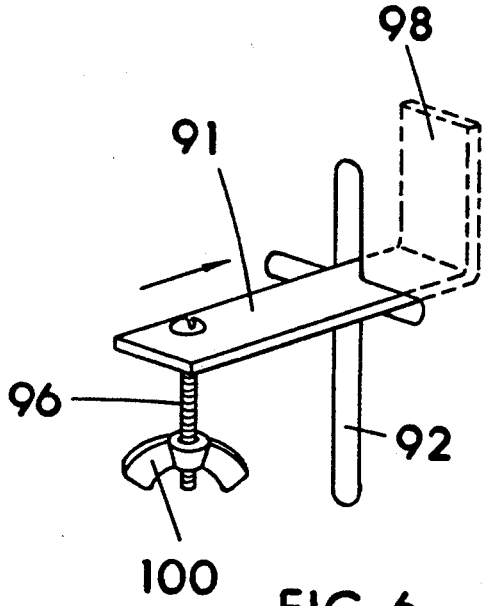
FIG. 6 is the attachment clip having been progressed further in installation.
Figure 7:
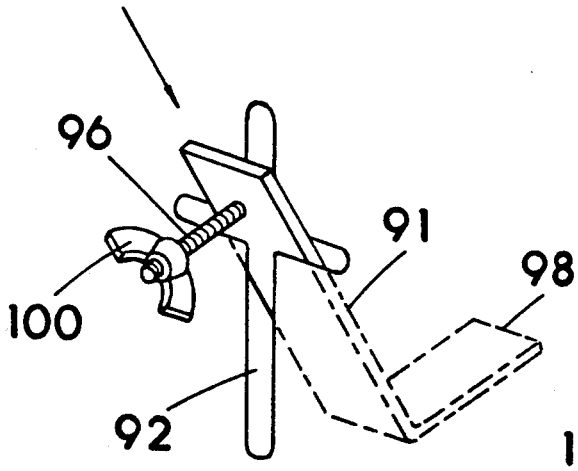
FIG. 7 is the attachment clip having been progressed even further in installation.
Figure 8:
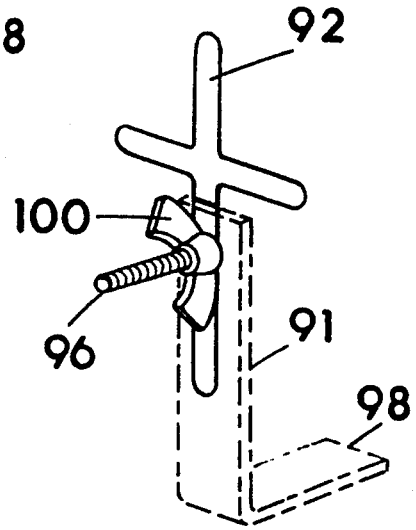
FIG. 8 is the attachment clip further installed in the housing.

The second attachment system, and the one which will most likely only be used during remodeling when the finished ceiling 94 is in place, uses a plurality of L-shaped attachment clips 91. When using attachment clips 91, the band 78 with attachment arms 72 is removed from housing 10 and not used. In order to use attachment clips 91, housing 10 includes a plurality of cross-shaped apertures 92 through the sidewall of the housing 10. Three or four cross-shaped apertures 92 will normally be used spaced equal distance from one another around the housing 10 and positioned above or further away from the open end of the housing 10 than flange 16. Using attachment clips 91, housing 10 may be installed into an existing finished ceiling 94 without accessing an attic above the ceiling 94. During a remodel in multi-story building, it is not always possible to enter an attic, particularly when most of the time there is no accessible attic between the ceiling 94 of a lower story room and the adjacent floor of the room one flight up. To install housing 10, a hole must be cut in the finished ceiling 94 just large enough to allow the insertion of the closed end 14 of the housing through the hole, but not so large as to allow the flange 16 at the opened end 12 of the housing 10 to pass through the hole. This hole in the ceiling may be cut around or adjacent an electrical box in the ceiling 94 from which 120 volts AC power may be obtained to connect to the power supply 28. The hole in the ceiling 94 may be cut in an area absent any 120 volt electrical power, whereat the batteries 34 would be used as the electrical power source of the smoke detector circuit board 36. Once the hole in the ceiling 94 is cut to the proper size, if available, 120 volt AC wires may be obtained through the hole and connected to the junction box 26 and power supply 28. The housing 10 is then inserted through the hole and the flange 16 is brought to tight abutment against the finished ceiling 94 surrounding the hole in which the housing 10 resides. Normally there is at least 10 to 14 inches of open space above the finished ceiling even when there is no attic. With the housing 10 inserted in the hole and the flange 16 abutted against the ceiling, attachment clips 91 may be inserted through the cross-shaped apertures 92 in housing 10, one attachment clip 9 per cross-shaped aperture 92. Shown best in FIGS. 4 through 8, each of the attachment clips 91 is a rigid essentially L-shaped member suitably made of metal. Each attachment clip 91 includes an affixed threaded stud 96 attached toward one end of the L-shaped member, with the stud 96 extending outward away from the member in the opposite direction as the foot 98 of the clip 91. On the threaded stud 96 is a wingnut 100. FIGS. 5 and 8 illustrate the process of inserting a clip 91 through a cross-shaped aperture 92 wherein the clip 91 is being inserted from inside the housing 10 with the canister 58 removed. The foot 98 is first inserted through the cross portion of the cross-shaped aperture 92. The dotted line portion of the clip 91 represents that portion of the clip 91 which is on the outside of the housing 10. The foot 98 is inserted first, with the wingnut 100 backed a significant distance from the clip 91 body. When the clip 91 is fully installed as in FIG. 8, the stud 96 and wingnut 100 are positioned within the interior of housing 10, and the shank of the stud 96 is small enough to slide in the cross-shaped aperture 92, and the wingnut 100 is too large to pass through the slot of aperture 92. By using the stud 96 as a location to grip, the clip 91 with foot portion 98 is slid downward to press tightly against the top surface of the finished ceiling 94 which has the effect of pulling the flange 16 tightly against the bottom or oppositely disposed surface of the ceiling 94 at which point the wingnut 100 is tightened to secure the clip 91 stationary against the housing. When all clips 91 are in place and secured, housing 10 is retained in place against the finished ceiling 94 as may be ascertained from FIG. 4. At this point, canister 58 may be installed, followed by smoke detector circuit board 36, and finally by trim plate 22.

Figure 9:
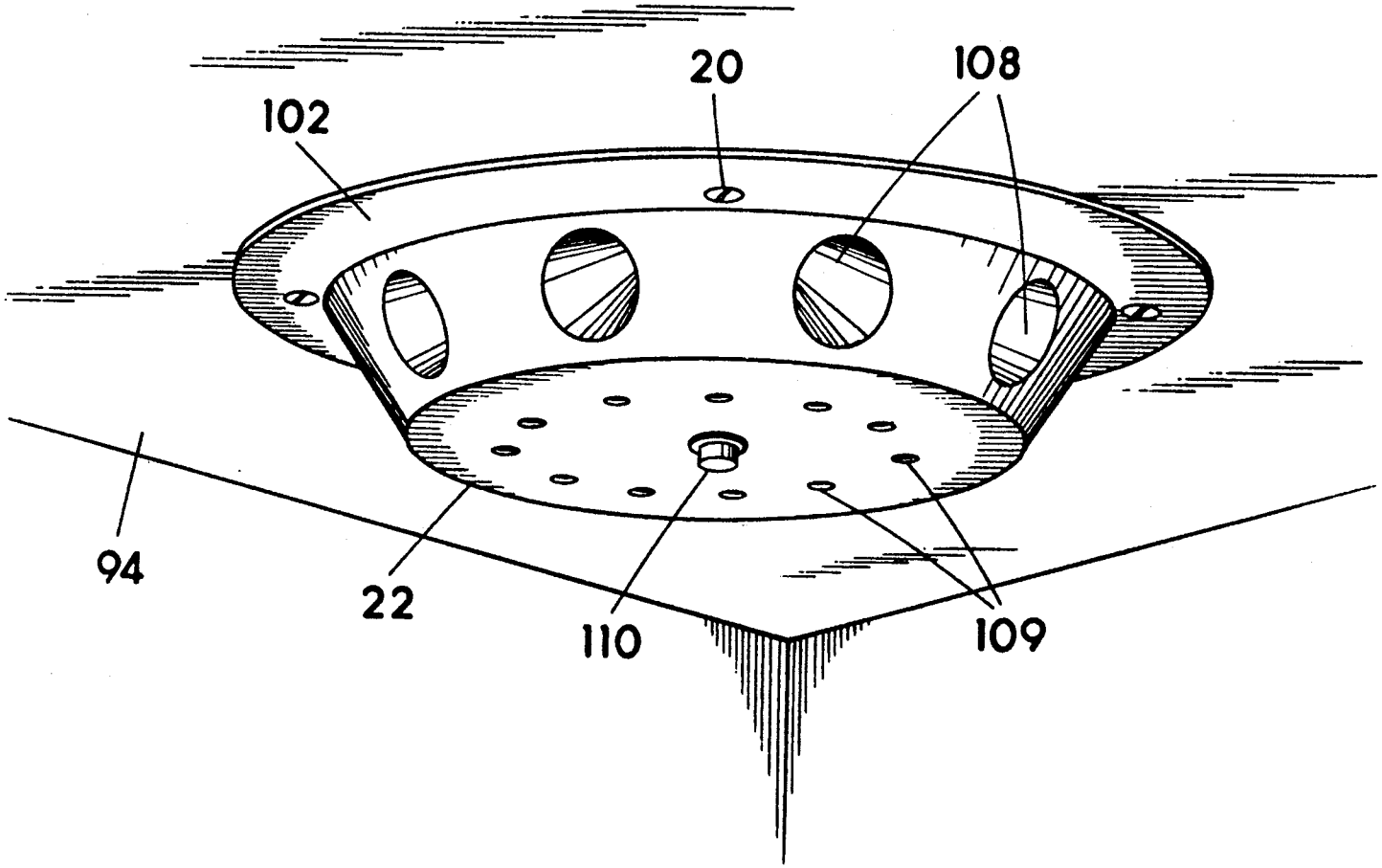
FIG. 9 illustrates the preferred embodiment of FIG. 1 installed in a ceiling showing only the trim plate which also serves as a powder dispersal arrangement.

Trim plate 22, shown best in FIGS. 1, 4, and 9, is a bowl shaped disk having an outer flange or rim 102 which is large enough in diameter to cover flange 16 of housing 10. Rim 102 has a series of screw apertures 104 for attachment of trim plate 22 to flange 16 with screws 20. Trim plate 22 also has apertures 109 which serve to allow heat and smoke access to smoke detector circuit board 36. Within the concave interior surface of trim plate 22 is a powder manifold 106 which receives fire retardant powder 56 from the output side of solenoid valve 52 when the valve 52 is open. Manifold 106 distributes the fire retardant powder 56 through a plurality of cone shaped distribution tubes 108 out into the room. Distribution tubes 108 are attached to powder manifold 106 to structurally support the manifold. Powder manifold 106 includes a cylindrical rubberized hollow tube, the upper open end of which is sized for placement over nipple 64 of canister 58. The resilient nature of the rubberized material of powder manifold 106 allows a snug frictional attachment to nipple 64. The open interior chamber of powder manifold 106 communicates with the hollow interior of each cone shaped distribution tube 108, which is each affixed, at the narrow end, radially around the exterior of powder manifold 106, as shown in FIG. 1. The larger open ends of distribution tubes 108 are attached to and open through the outer wall of trim plate 22, allowing ejection of retardant powder 56 out into the room. The cone shape of the distribution tube 108 allows the retardant 56 to be disbursed in a wide pattern, and the radial placement of the openings of distribution tubes 108 through trim plate 22 allows for a 360 degree dispersement pattern.

Located on the bottom surface of trim plate 22 is test button 110. Test button 110 is for intermittently verifying the proper functioning of the device, indicated by the audible alarm sounding when button 110 is pushed. The actual casing of the button portion of test button 110 might also be transparent if desired, allowing continuous viewing of a LED light which, when not lighted, would indicate a malfunction in the system or drained batteries 34.

Test button 110 receives power from circuit board 36 via conductor 120. Conductor 120 is endwardly affixed with plug 122, which is adapted for removable insertion into an electrical receptacle 123 affixed to circuit board 36.

Figure 10:
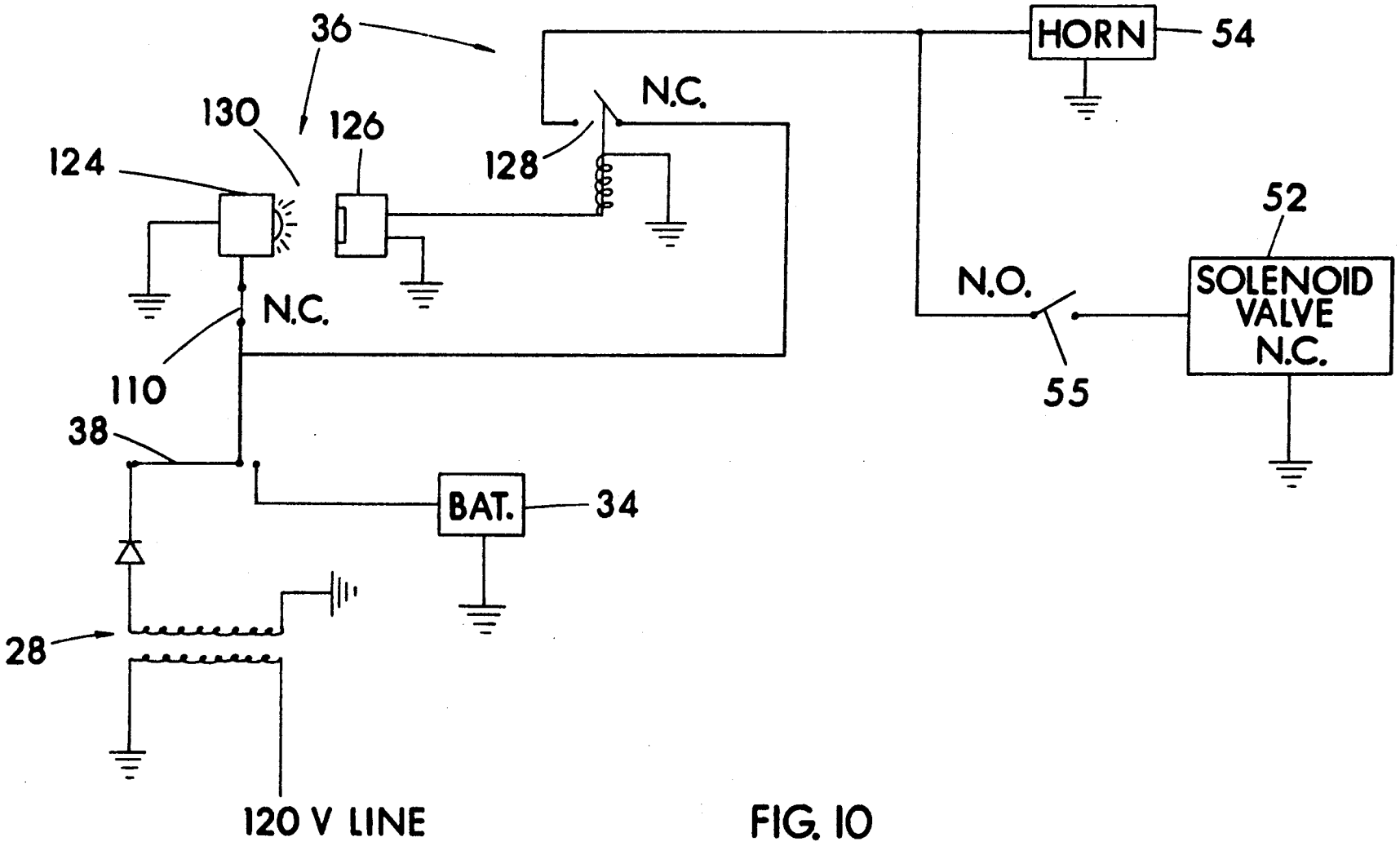
FIG. 10 is a basic diagram of one possible circuit for a smoke detector with audible alarm and solenoid control valve for releasing fire retardant powder from the canister.

FIG. 10 is a basic diagram of one possible circuit for a smoke detector with audible alarm and solenoid control valve for releasing fire retardant powder. In the diagram, power supply 28 is shown receiving 120 volts AC power which is being transformed to a lower voltage and rectified to DC. Switch 38 is shown switched to receive the transformed voltage rather than from battery 34. The normally closed test switch 110 is in line with power into an LED 124. LED 124 is shown emitting light across a gap 130 and into a photoelectric cell 126. Photoelectric cell 126 generates electricity as long as LED 124 emits light, and smoke does not block the light from spanning the gap 130 between LED 124 and photoelectric cell 126. Electricity from photoelectric cell 126 is used to hold open a normally closed contact in an electromagnetic relay 128. The normally closed contacts of electromagnetic relay 128 maintains an incomplete circuit between power for the horn 54 for as long as photoelectric cell 126 is generating electricity. Should the smoke block the light from spanning the gap between LED 124 and photoelectric cell 126, electricity from photoelectric cell 126 will be insufficient to allow the coil in electromagnetic relay 128 to hold open the normally closed contacts therein, which will close completing the circuit to horn and to normally open close-on-temperature-rise switch 55. Horn 54 will now be sounding, and if sufficient heat is present, normally-open close-on-temperature-rise switch 55 will close completing the circuit to the normally closed solenoid valve 52 which will opened and thus will release the fire retardant powder. In this arrangement, test button 110 could alternatively be a non-electrical device which when pushed would actually block light from spanning gap 130. There are many other way which may be utilized to make a smoke detector with audible alarm, such as the common ionization process type for example.

Although I have very specifically described structures of the invention, it should be understood that the specific details are given for example. Many minor changes in the specific structures described may obviously be made without departing from the scope of the invention, and therefore it should be understood that the scope of the invention is not to be limited by the specification and drawings given for example, but is to be determined by the spirit and scope of the appended claims.

What I claim as my invention is:

1. A combination smoke detector with an audible alarm and an automatic fire extinguisher for mounting in a ceiling of a room; comprising, a housing having at least one open end, an outwardly extending flange attached to said housing adjacent said open end, a junction box supported by said housing for making electrical connections therein, said junction box including means for accepting at least one electrical power cable from an external alternating current power source, means for retaining at least one battery, an electric power supply means having means for electrical communication with a source of alternating current and with said battery, said electric power supply means being switchable between using alternating current and battery electrical power, said electric power supply means for properly conditioning and communicating electricity for operating a smoke detector means with audible alarm means, said smoke detector means with audible alarm means attached to said housing, said smoke detector means with audible alarm means including means for sensing the presence of smoke, and sounding an audible alarm upon sensing smoke;

a pressurized canister containing fire retardant powder, said canister positioned within said housing and removably held therein by retention means, said canister having a dispensing opening aiming toward said open end of said housing, a normally closed solenoid valve attached over said dispensing opening of said canister, said solenoid valve actuatable into an open position to release said fire retardant powder by way of electrical circuitry requiring both a condition of sensed smoke by said smoke detector means with audible alarm means and simultaneously a condition of abnormally high temperature, a powder distributor positioned to receive fire retardant powder from said canister upon the opening of said solenoid, said powder distributor structured to distribute said fire retardant powder radially outward through a decorative trim plate attachable to said housing at said open end of said housing, a first attachment means for attaching said housing to a building structure, said first attachment means including two sets of length adjustable attachment arms removably attached to said housing and having means in distal ends of said attachment arms to facilitate the fastening thereof with mechanical fasteners to structures of a building to support said housing, a second attachment means for attaching said housing to a finished ceiling, said second attachment means including a plurality of cross-shaped apertures in said housing each positioned further from said opened end of said housing than said flange, each cross-shaped aperture sized cooperatively for receiving an L-shaped attachment clip inserted through said cross-shaped aperture from within an interior of said housing, each attachment clip having an affixed threaded stud extending therefrom in an oppositely disposed angle from a foot portion of said attachment clip, a nut on said threaded stud for securing said attachment clip stationary to said housing with said attachment clip positioned on the exterior of said housing and said foot of said attachment clip against a backside of a finished ceiling and said nut positioned within the interior of said housing.

* * * * *